US010836612B1

(12) United States Patent
Masuda et al.

(10) Patent No.: US 10,836,612 B1
(45) Date of Patent: Nov. 17, 2020

(54) CRANE

(71) Applicant: TADANO LTD., Kagawa (JP)

(72) Inventors: Naotaka Masuda, Lauf a.d. Pegnitz (DE); Kenji Urushihara, Kagawa (JP); Takashi Kawano, Kagawa (JP)

(73) Assignee: TADANO LTD., Kagawa (JP)

( * ) Notice: Subject to any disclaimer, the term of this patent is extended or adjusted under 35 U.S.C. 154(b) by 0 days.

(21) Appl. No.: 16/954,125

(22) PCT Filed: Dec. 18, 2018

(86) PCT No.: PCT/JP2018/046610
§ 371 (c)(1),
(2) Date: Jun. 16, 2020

(87) PCT Pub. No.: WO2019/124390
PCT Pub. Date: Jun. 27, 2019

(30) Foreign Application Priority Data

Dec. 18, 2017 (JP) ..... 2017-241947

(51) Int. Cl.
*B66C 13/20* (2006.01)
*B66C 23/00* (2006.01)
(Continued)

(52) U.S. Cl.
CPC ..... *B66C 13/20* (2013.01); *B66C 23/54* (2013.01); *B66C 23/88* (2013.01); *B66D 1/505* (2013.01);
(Continued)

(58) Field of Classification Search
CPC ..... B66C 13/20; B66C 15/00; B66C 23/54; B66C 23/88; B66D 1/54; B66D 1/505
See application file for complete search history.

(56) References Cited

U.S. PATENT DOCUMENTS

2012/0285152 A1* 11/2012 Sugano ..... B66D 1/44 60/325
2013/0311051 A1* 11/2013 Torii ..... B66C 13/20 701/50
2019/0106301 A1* 4/2019 Masuda ..... B66C 23/86

FOREIGN PATENT DOCUMENTS

JP 54149161 A * 11/1979 ..... B66C 1/44
JP H07-187585 A 7/1995
(Continued)

OTHER PUBLICATIONS

Machine Translation of JP 2017186156A. (Year: 2017).*
(Continued)

*Primary Examiner* — Michael R Mansen
*Assistant Examiner* — Juan J Campos, Jr.
(74) *Attorney, Agent, or Firm* — Paratus Law Group, PLLC

(57) ABSTRACT

The present invention is provided with: a manipulation unit; a winch device that operates with an actuation mode of either a high speed mode or a low speed mode, and winds in or reels out a wire rope; a selection unit for an operator to select either the high speed mode or the low speed mode; a load calculation unit calculating a suspended load; a tension calculation unit calculating the tension of the wire rope; and a control unit controlling the actuation of the winch device. If the mode selected by the selection unit is the high speed mode, the manipulation unit is manipulated from a neutral state to a non-neutral state, and the suspended load is smaller than a load threshold and the tension is smaller than a tension threshold, the control unit controls the winch device so as to operate in the high speed mode.

5 Claims, 7 Drawing Sheets

(51) Int. Cl.
*B66D 1/50* (2006.01)
*B66C 23/88* (2006.01)
*B66C 23/36* (2006.01)

(52) U.S. Cl.
CPC ..... *B66C 23/36* (2013.01); *B66C 2700/0371* (2013.01)

(56) References Cited

FOREIGN PATENT DOCUMENTS

| | | | | | |
|---|---|---|---|---|---|
| JP | 2005-231808 | A | | 9/2005 | |
| JP | 4527860 | B2 | | 8/2010 | |
| JP | 2012-062175 | A | | 3/2012 | |
| JP | 2013-237526 | A | | 11/2013 | |
| JP | 2017186156 | A | * | 10/2017 | ..... B66C 13/20 |

OTHER PUBLICATIONS

Machine Translation of JP 54149161A (Year: 1979).*
Machine Translation of JPH 07187585A (Year: 1995).*
Machine Translation of JP 2002068667A (Year: 2002).*
Machine Translation of JP 2012062175A (Year: 2012).*
Machine Translation of JP 2005231808A (Year: 2005).*
Mar. 26, 2019, International Search Report issued for related PCT Application No. PCT/JP2018/046610.
Mar. 26, 2019, International Search Opinion issued for related PCT Application No. PCT/JP2018/046610.
Jun. 25, 2019, Notice of Reasons for Refusal issued for related JP Application No. 2019-524091.
Aug. 27, 2019, Decision to Grant a Patent issue for related JP Application No. 2019-524091.

* cited by examiner

CRANE

CROSS REFERENCE TO PRIOR APPLICATION

This application is a National Stage Patent Application of PCT International Patent Application No. PCT/JP2018/046610 (filed on Dec. 18, 2018) under 35 U.S.C. § 371, which claims priority to Japanese Patent Application No. 2017-241947 (filed on Dec. 18, 2017), which are all hereby incorporated by reference in their entirety.

TECHNICAL FIELD

The present invention relates to a crane. In particular, the present invention relates to a crane including a winch system that controls a displacement of a high/low speed hydraulic motor using a detected load.

BACKGROUND ART

A wide range of tensions and velocities are required for wire ropes driven by hydraulic winches of mobile cranes. A variable displacement motor is used as one of the means for achieving this.

In addition, there is also a technique called free fall for freely lowering a hook provided at a distal end of a wire rope. In order to realize this technique, a clutch is provided between a fixed displacement motor and a winch drum. Then, when realizing the free fall, an operator freely lowers the hook provided at the distal end of the wire rope by disengaging the clutch. Instead of such a free fall, a variable displacement motor is also used in the case of realizing high-speed lowering of the wire rope.

A mobile crane has a load detector for a lifting load. A technique for controlling a displacement of a variable displacement motor based on the load detected by the load detector has been developed. As one type of variable displacement motor, there is a high/low speed hydraulic motor that can be switched to either a large displacement or a small displacement.

In a winch system described in Patent Literature 1, a lifting load, calculated by an overload prevention device immediately before the start of lowering manipulation is stored as an actually manipulated lifting load until the end of the lowering manipulation. Then, when the actually manipulated lifting load is smaller than a predetermined value, an actuation mode of the winch system is switched to a high speed mode.

CITATION LIST

Patent Literature

Patent Literature 1: Japanese Patent No. 4527860

SUMMARY OF THE INVENTION

Problems to be Solved by the Invention

The winch system described in Patent Literature 1 is a technique for lowering a suspended load that is suspended in the air. Therefore, it is difficult to apply the above winch system to hoisting manipulation from lifting off the ground where the lifting load detected by the overload prevention device becomes zero immediately before the start of the winch manipulation. Therefore, the invention described in Patent Literature 1 has a problem that it is difficult to improve operability at the time of lifting off the ground.

An object of the present invention is to realize a crane that can improve operability.

Solutions to Problems

One aspect of a crane according to the present invention includes: a manipulation unit; a winch device that operates with an actuation mode of either a high speed mode or a low speed mode on the basis of manipulation of the manipulation unit, and winds in or reels out a wire rope to which a hook is fixed; a selection unit for an operator to select either the high speed mode or the low speed mode; a load calculation unit for calculating a suspended load; a tension calculation unit for calculating the tension of the wire rope; and a control unit for controlling the actuation of the winch device. If the mode selected by the selection unit is the high speed mode, the manipulation unit is manipulated from a neutral state to a non-neutral state, the suspended load is smaller than a load threshold, and the tension is smaller than a tension threshold, the control unit controls the winch device so as to operate in the high speed mode.

According to the present invention, it is possible to realize the crane that can improve the operability.

DESCRIPTION OF EMBODIMENTS

Figure 1:
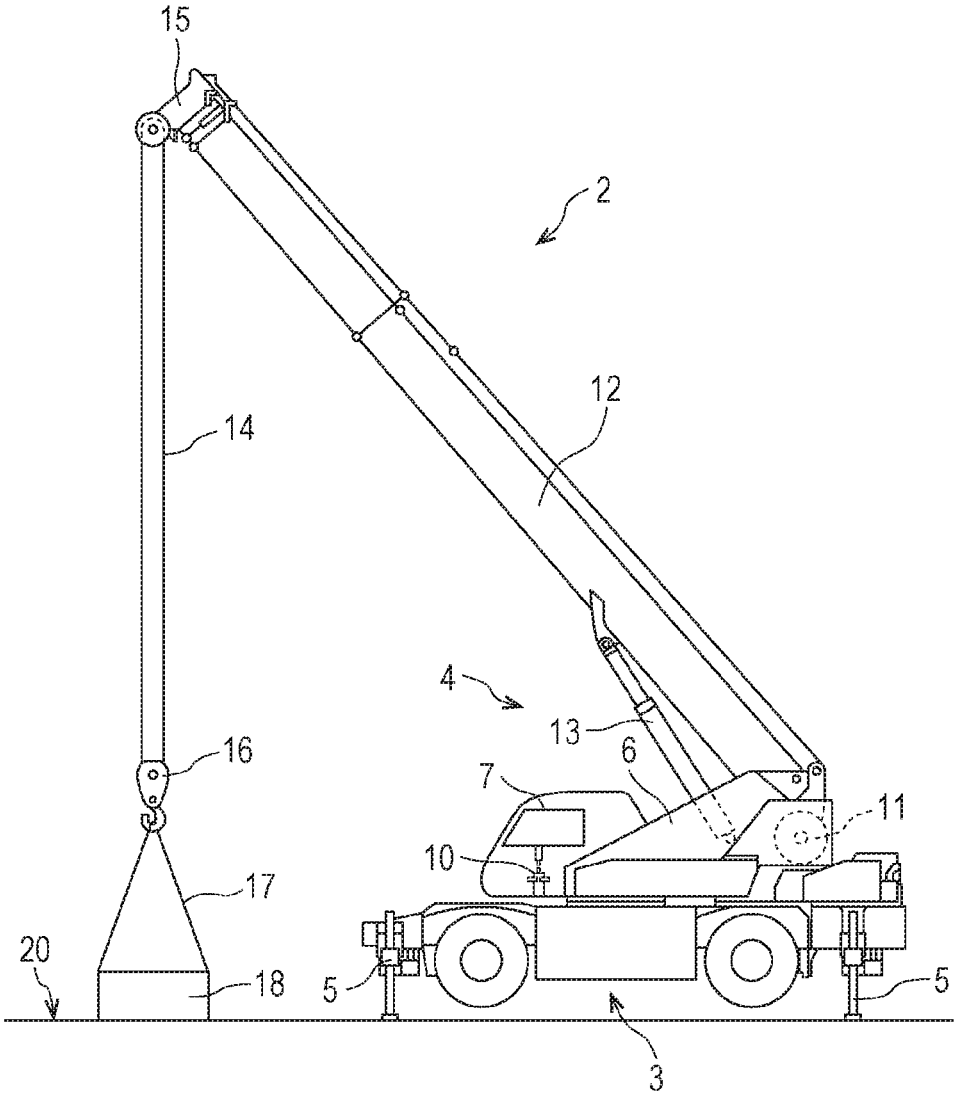
FIG. 1 is a view illustrating a rough terrain crane according to an embodiment of the present invention.

FIG. 1 illustrates a rough terrain crane 2 according to an embodiment of the present invention. The rough terrain crane 2 has a winch system 1. The rough terrain crane 2 includes a vehicle section 3 and a swivel section 4 which is rotatably mounted on the vehicle section 3. The vehicle section 3 is provided with an outrigger 5. The rough terrain crane 2 illustrated in FIG. 1 has the outrigger 5 that overhangs.

A cab 7 is mounted on a swivel frame 6 of the swivel section 4. In the cab 7, a manipulation lever 10 of the winch system 1 is arranged. A winch 11 is arranged on the swivel frame 6. A telescoping boom 12 is pivotally attached to the swivel frame 6 so as to be freely raised and lowered. A derricking cylinder 13 is arranged between the telescoping boom 12 and the swivel frame 6. The rough terrain crane 2 illustrated in FIG. 1 is in a crane operation posture in which the telescoping boom 12 is extended after the telescoping boom 12 is raised by the derricking cylinder 13.

As illustrated in FIG. 1, a wire rope 14 reeled out from the winch 11 is hung around a distal end portion 15 of the telescoping boom and a hook 16. A sling wire rope 14 for suspending a suspended load 18 is hung on the hook 16. The rough terrain crane 2 illustrated in FIG. 1 is in a state immediately before lifting off the ground in which the suspended load 18 is grounded on a ground 20.

Figure 2:
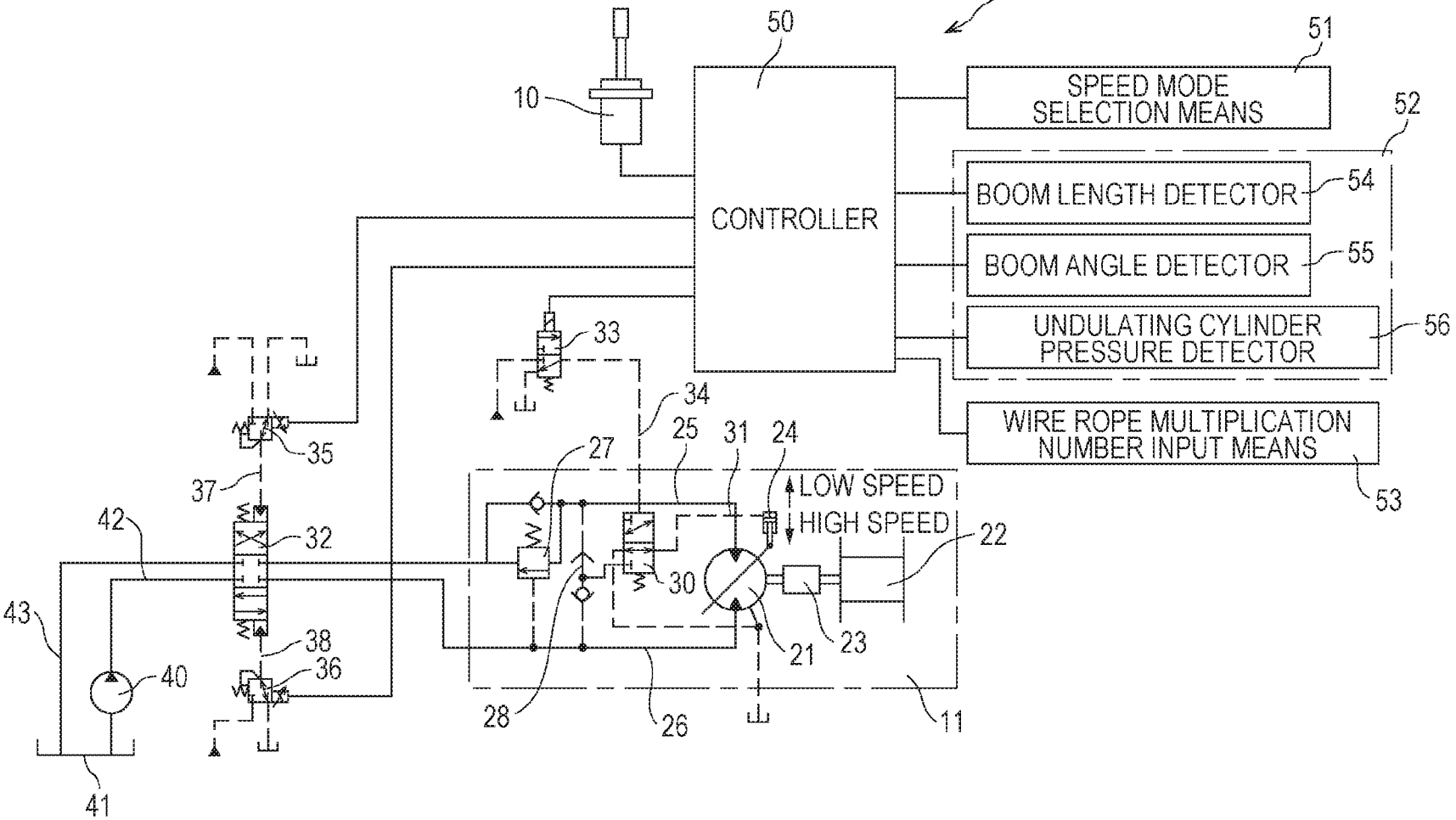
FIG. 2 is a diagram illustrating a winch system.

FIG. 2 is a hydraulic circuit forming the winch system 1 of the rough terrain crane 2 and a control block diagram according to the embodiment of the present invention. The winch 11 has a high/low speed hydraulic motor 21 capable of driving a winch drum 22 to rotate forwardly and reversely via a speed reducer 23. The high/low speed hydraulic motor 21 can switch a displacement required for one rotation between large and small to switch a rotational speed with respect to a supply flow rate to one of a high speed mode and a low speed mode. When the high/low speed hydraulic motor 21 is in the high speed mode, an actuation mode of the winch 11 is a high speed mode. On the other hand, when the high/low speed hydraulic motor 21 is in the low speed mode, the actuation mode of the winch 11 is a low speed mode. The motor displacement of the high/low speed hydraulic motor 21 is always biased to the large displacement side. The motor displacement is controlled to be switched between large and small by a control cylinder 24.

The high/low speed hydraulic motor 21 is connected with an oil passage 25 on a hoisting side and an oil passage 26 on a lowering side. A counter balance valve 27 is provided in the oil passage 25 on the hoisting side. A shuttle valve 28 is provided between the oil passage 25 on the hoisting side and the oil passage 26 on the lowering side. The shuttle valve 28 and the control cylinder 24 communicate with each other by an oil passage 31 via a pilot switching valve 30. The shuttle valve 28 picks up a motor operating pressure generated in the oil passage 25 on the hoisting side or the oil passage 26 on the lowering side and transmits the motor operating pressure to the pilot switching valve 30. The pilot switching valve 30 switches between communication and interruption of the motor operating pressure to the control cylinder 24.

The pilot switching valve 30 communicates with an electromagnetic switching valve 33 by an oil passage 34. When a pilot pressure is sent from the electromagnetic switching valve 33 to the pilot switching valve 30 via the oil passage 34, the pilot switching valve 30 switches to the communication side. The pilot switching valve 30 and the electromagnetic switching valve 33 constitute a high/low speed switching valve. When the motor operating pressure is communicated from the pilot switching valve 30 to the control cylinder 24 (when hydraulic oil is supplied), the high/low speed hydraulic motor 21 is switched to the small displacement side corresponding to the high speed side. On the other hand, when the supply of hydraulic oil from the pilot switching valve 30 to the control cylinder 24 is interrupted, the high/low speed hydraulic motor 21 is switched to the large displacement side corresponding to the low speed side.

The oil passage 25 on the hoisting side and the oil passage 26 on the lowering side communicate with a pilot switching valve 32 that controls a direction and a flow rate of the pressure oil supplied to the winch 11. The pilot switching valve 32 communicates with a proportional solenoid valve 35 on the hoisting side by an oil passage 37. The pilot switching valve 32 communicates with a proportional solenoid valve 36 on the lowering side by an oil passage 38. The pilot switching valve 32 and a hydraulic pump 40 communicate with each other by an oil passage 42 on a pump side. The pilot switching valve 32 and the oil tank 41 communicate with each other by an oil passage 43 on a returning side. A switching direction and a switching amount of the pilot switching valve 32 are controlled by the proportional solenoid valve 35 and the proportional solenoid valve 36.

As illustrated in FIG. 2, a controller 50 communicates with the manipulation lever 10, a speed mode selection means 51, a load detection means 52, and a wire rope multiplier input means 53 by signal lines, respectively. Specifically, the load detection means 52 includes a boom length detector 54, a boom angle detector 55, and a derricking cylinder pressure detector 56 which are known in the art. In addition, the controller 50 communicates with the high/low speed electromagnetic switching valve 33, the hoisting-side proportional solenoid valve 35, and the lowering-side proportional solenoid valve 36 by signal lines, respectively.

The manipulation lever 10 is arranged in the cab (see FIG. 1), and energization to any valve between the proportional solenoid valve 35 on the hoisting side and the proportional solenoid valve 36 on the lowering side is selected depending on a switching direction of the manipulation lever 10. Further, an intensity level of a signal sent to the proportional solenoid valves 35 and 36 changes in response to the manipulation amount of the manipulation lever 10. The manipulation lever 10 corresponds to an example of a manipulation unit.

The speed mode selection means 51 is arranged in the cab (see FIG. 1). An operator in the cab can select either the high speed side or the low speed side by the speed mode selection means 51. The speed mode selection means 51 corresponds to an example of a selection unit.

The wire rope multiplier input means 53 is arranged in the cab (see FIG. 1). The operator in the cab can manually input a recognized multiplier from the wire rope multiplier input means 53. Note that the wire rope multiplier input means 53 may be configured such that a wire rope multiplier detector is arranged at the distal end portion 15 (see FIG. 1) of the telescoping boom to automatically input the wire rope multiplier.

Figure 3:
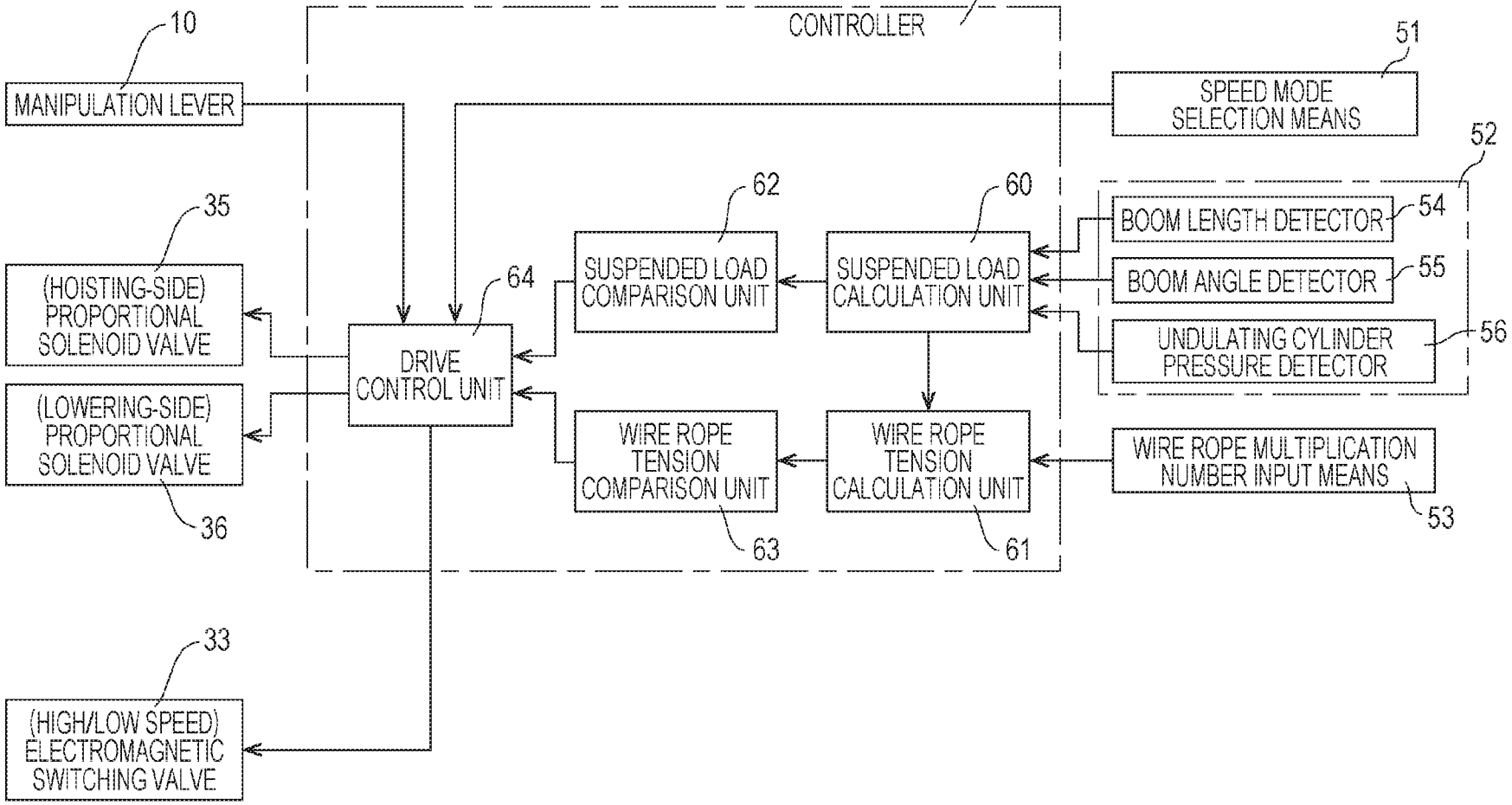
FIG. 3 is a block diagram of a controller.

FIG. 3 is a block diagram of the controller 50. The controller 50 includes a suspended load calculation unit 60, a wire rope tension calculation unit 61, a suspended load comparison unit 62, a wire rope tension comparison unit 63, and a drive control unit 64.

As an example, the suspended load calculation unit 60 calculates a suspended load based on a boom length detected by the boom length detector 54, a boom angle detected by the boom angle detector 55, and a derricking cylinder pressure detected by the derricking cylinder pressure detector 56. The suspended load calculation unit 60 corresponds to an example of a load calculation unit.

As an example, the wire rope tension calculation unit 61 calculates a wire rope tension based on the suspended load calculated by the suspended load calculation unit 60 and the wire rope multiplier input by the wire rope multiplier input means 53. The wire rope tension calculation unit 61 corresponds to an example of a tension calculation unit.

The suspended load comparison unit 62 compares a suspended load calculation value calculated by the suspended load calculation unit 60 with one suspended load threshold stored in the suspended load comparison unit 62. The suspended load threshold is a value larger than a wire rope tension threshold to be described later. The wire rope tension comparison unit 63 compares a wire rope tension calculation value calculated by the wire rope tension calculation unit 61 and one wire rope tension threshold stored in the wire rope tension comparison unit 63. The wire rope tension threshold may be set in consideration of an allowable pressure of the high/low speed hydraulic motor 21 in which the motor displacement is switched to the small displacement, the specifications of the winch system 1, and the like.

As an example, the drive control unit 64 outputs a switching signal of the electromagnetic switching valve 33 based on the signals from the manipulation lever 10, the speed mode selection means 51, the suspended load comparison unit 62, and the wire rope tension comparison unit 63. Specifically, the drive control unit 64 outputs a signal for switching the electromagnetic switching valve 33 to the high speed side if the speed mode selection means 51 selects the high speed side (condition 1), the manipulation lever 10 is manipulated from neutral to non-neutral (condition 2), the suspended load calculation value is smaller than the suspended load threshold (condition 3), and the wire rope tension calculation value is smaller than the wire rope tension threshold (condition 4).

In other words, the drive control unit 64 controls the winch 11 to operate in the high speed mode if the actuation mode selected by the speed mode selection means 51 is the high speed mode (high speed side), the manipulation lever 10 is manipulated from a neutral state to a non-neutral state, the suspended load calculation value is smaller than the suspended load threshold, and the wire rope tension is smaller than the wire rope tension threshold. That is, in the case of the present embodiment, the winch 11 does not operate in the high speed mode if the above conditions 2 to 4 are not satisfied even when the operator selects the high speed side by the speed mode selection means 51. Note that the drive control unit 64 corresponds to an example of a control unit.

Figure 4:
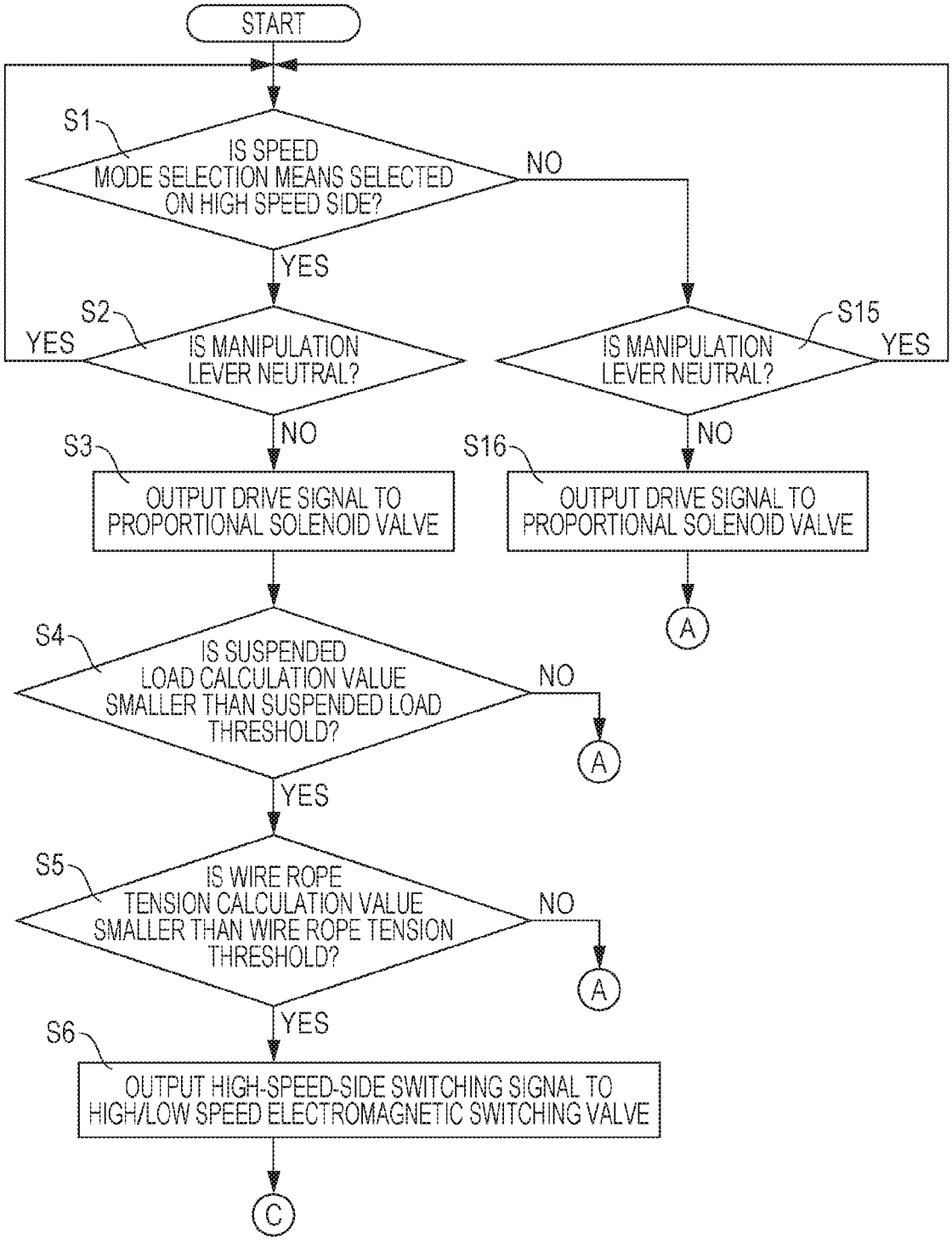
FIG. 4 is a flowchart illustrating processing performed by the controller.

The operation of the winch system 1 of the rough terrain crane 2 according to the above-described embodiment will be described. FIG. 4 is a flowchart illustrating processing performed by the controller 50.

(Case of Lifting Off Ground and Hoisting Under High Speed Mode Selection)

A description will be given regarding an example of control in the case of hoisting the suspended load 18 in the high speed mode from the state of being grounded on the ground 20 (see FIG. 1) will be described. As illustrated in FIG. 4, in Step S1, the controller 50 determines whether the mode selected by the speed mode selection means 51 is the high speed side (high speed mode). In Step S1, if the speed mode selection means 51 selects the high speed side ("YES" in Step S), the control process transitions to Step S2. On the other hand, if the mode selected by the speed mode selection means 51 is not the high speed side (high speed mode) in Step S1 ("NO" in Step S1), the control process transitions to Step S15. In the case of this example, the controller 50 determines YES in Step S1.

Next, in Step S2 of FIG. 4, the controller 50 determines whether the manipulation lever 10 is neutral (also referred to as the neutral state). In Step S2, if the manipulation lever 10 is neutral ("YES" in Step S2), the control process transitions to Step S1. In addition, if the manipulation lever 10 is not neutral in Step S2 ("NO" in Step S2), the control process transitions to Step S3. Note that the case where the manipulation lever 10 is not neutral is, for example, a state where the manipulation lever 10 is manipulated from the neutral state to the non-neutral state. The non-neutral state includes a state where the manipulation lever 10 is located on the hoisting side and a state where the manipulation lever 10 is located on the lowering side. As Step S1 and Step S2 are repeated, the controller 50 determines whether the manipulation lever 10 has been switched from the neutral state to the non-neutral state in the state where an speed mode selection means 51 selects the high speed side. In the case of this example, the controller 50 determines NO in Step S2.

As an example, if the manipulation lever 10 is manipulated from neutral to the hoisting side in Step S2 of FIG. 4, the controller 50 outputs a drive signal to the proportional solenoid valve 35 on the hoisting side in Step S3 of FIG. 4. Then, the pilot pressure acts from the proportional solenoid valve 35 illustrated in FIG. 2 via the oil passage 37, and the pilot switching valve 32 is switched to the hoisting side. As a result, pressure oil is sent from the hydraulic pump 40 to the oil passage 25 on the hoisting side via the oil passage 42. In this way, the operating pressure of the high/low speed hydraulic motor 21 is established in the oil passage 25 on the hoisting side.

Next, the controller 50 determines whether the suspended load calculation value is smaller than the suspended load threshold in Step S4 of FIG. 4. As an example, the extension of the wire rope 14 and the bending of the telescoping boom 12 occur in an initial stage of lifting off the ground, and thus, the suspended load calculation value is extremely small. Therefore, the controller 50 determines YES in Step S4 in the case of this example. Note that the suspended load threshold may be, for example, a threshold for detection of the operation of lifting off the ground. In this case, the controller 50 compares the suspended load calculation value with the suspended load threshold to determine whether the operation of lifting off the ground is being performed in Step S4 of FIG. 4.

Next, the controller 50 determines whether the wire rope tension calculation value is smaller than the wire rope tension threshold in Step S5 of FIG. 4. As an example, the extension of the wire rope 14 and the bending of the telescoping boom 12 occur in the initial stage of lifting off the ground, and thus, the wire rope tension calculation value is extremely small. Therefore, the controller 50 determines YES in Step S5 in the initial stage of lifting off the ground. As above, it is determined if all the four conditions such as the selection of the high speed side by the speed mode selection means 51 (condition 1), the manipulation from neutral to non-neutral of the manipulation lever 10 (condition 2), the suspended load calculation value being smaller than the suspended load threshold (condition 3), and the wire rope tension calculation value being smaller than the wire rope tension threshold (condition 4) are satisfied. Note that the wire rope tension threshold may be a threshold for detecting the operation of lifting off the ground, for example. In this case, the controller 50 compares the wire rope tension calculation value with the wire rope tension threshold to determine whether the operation of lifting off the ground is being performed in Step S5 of FIG. 4.

Next, the controller 50 controls the drive control unit 64 to output a high-speed-side switching signal to the electromagnetic switching valve 33 in Step S6 of FIG. 4. As illustrated in FIG. 2, the electromagnetic switching valve 33 is switched to the communication side, the pilot pressure acts on the pilot switching valve 30 via the oil passage 34, and the pilot switching valve 30 switches to the communication side. Then, the motor operating pressure generated in the oil passage 25 on the hoisting side acts on the control cylinder 24 via the shuttle valve 28, the pilot switching valve 30, and the oil passage 31. As a result, the control cylinder 24 switches the high/low speed hydraulic motor 21 to the high speed side. Then, the control process transitions to Step S7 illustrated in FIG. 5.

As described above, if the high speed mode is selected by the speed mode selection means 51, hoisting is started at high speed in the initial stage of lifting off the ground where a lifting load calculation value and the wire rope tension calculation value are small regardless of the actual lifting load.

Figure 5:
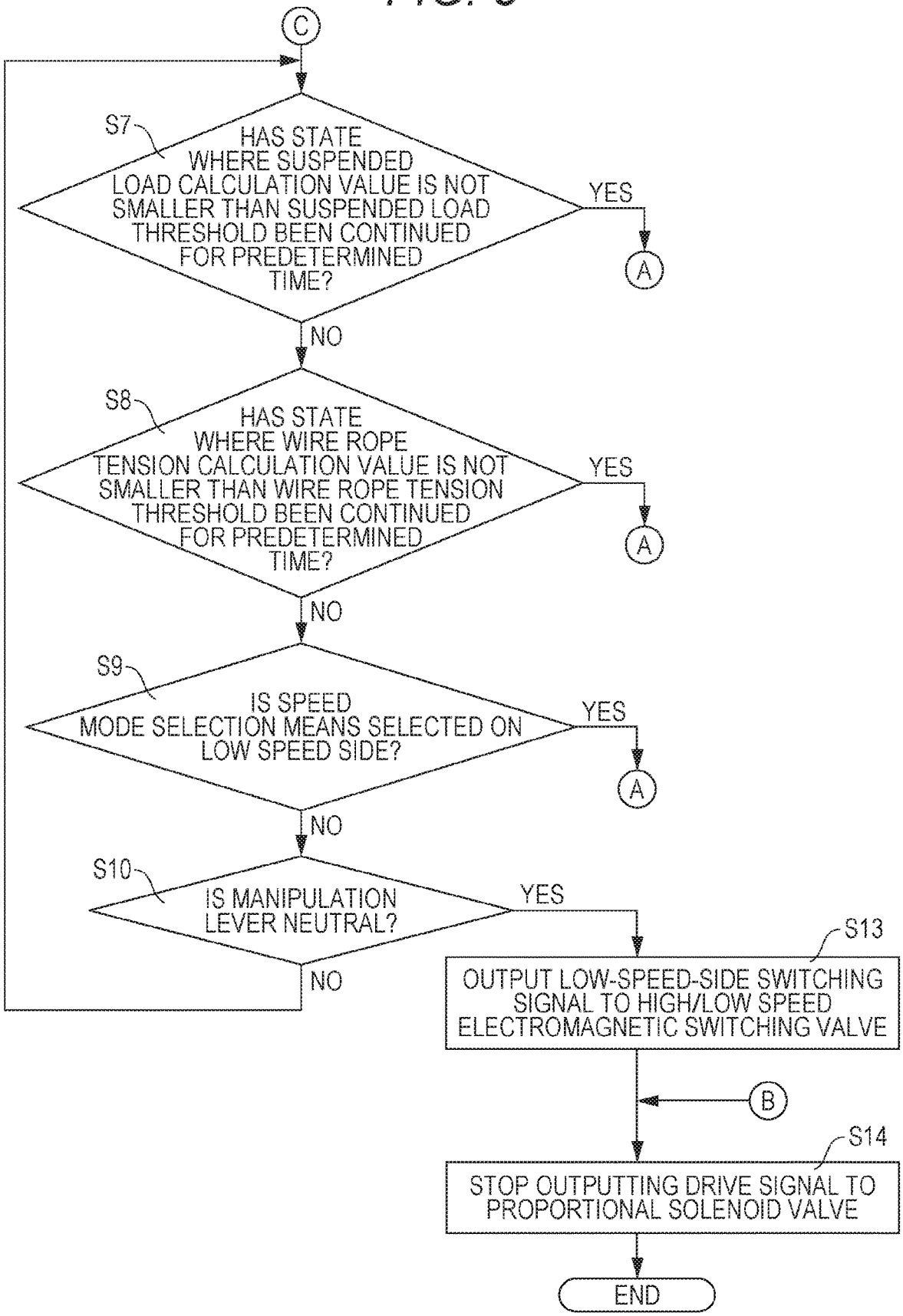
FIG. 5 is a flowchart illustrating processing performed by the controller.

Next, the controller 50 determines whether a state where the suspended load calculation value is not smaller than the suspended load threshold has continued for a predetermined time in Step S7 of FIG. 5. If the state where the suspended load calculation value is not smaller than the suspended load threshold (state where the suspended load calculation value is equal to or larger than the suspended load threshold) has continued for the predetermined time in Step S7 ("YES" in Step S7), the control process transitions to Step S11 in FIG. 6. On the other hand, if the state where the suspended load calculation value is not smaller than the suspended load threshold (state where the suspended load calculation value is equal to or larger than the suspended load threshold) has not continued for the predetermined time in Step S7 ("NO" in Step S7), the control process transitions to Step S8 in FIG. 5.

As an example, the predetermined time is set to several seconds. Since the continuation for several seconds is set as the condition, it is possible to prevent the control from becoming unstable due to an apparent load change caused by the vibration of the telescoping boom or the wire rope. In the initial stage of lifting off the ground, the suspended load calculation value is extremely small. Therefore, the controller 50 determines NO in Step S7 in the initial stage of lifting off the ground. Note that, as an example, the above-described predetermined time may be determined in consideration of the time required for the load change to subside after the generation of the apparent load change due to the vibration occurs when the vibration has occurred in the telescoping boom or the wire rope.

Next, in Step S8 of FIG. 5, the controller 50 determines whether a state where the wire rope tension calculation value is not smaller than the wire rope tension threshold (state where the wire rope tension calculation value is equal to or larger than the wire rope tension threshold) has continued for a predetermined time. In Step S8, if the state where the wire rope tension calculation value is not smaller than the wire rope tension threshold (state where the wire rope tension calculation value is equal to or larger than the wire rope tension threshold) has continued for the predetermined time ("YES" in Step S8), the control process moves to Step S11 in FIG. 6. On the other hand, if the state where the wire rope tension calculation value is not smaller than the wire rope tension threshold (state where the wire rope tension calculation value is equal to or larger than the wire rope tension threshold) has not continued for the predetermined time in Step S8 ("NO" in Step S8), the control process moves to Step S9 in FIG. 5.

As an example, the predetermined time is set to several seconds similarly to Step S7. Here, it is determined as NO since the wire rope tension calculation value is extremely small in the initial stage of lifting off the ground. Note that, as an example, the above-described predetermined time may be determined in consideration of the time required for a wire rope tension change to subside after generation of an apparent wire rope tension change due to the vibration occurs when the vibration has occurred in the telescoping boom or the wire rope.

Next, the controller 50 determines whether the speed mode selection means 51 has selected the low speed side in Step S9 of FIG. 5. If the speed mode selection means 51 selects the low speed side in Step S9, the control process transitions to Step S11 in FIG. 6. On the other hand, if the speed mode selection means 51 does not select the low speed side in Step S9, the control process transitions to Step S10 in FIG. 5. Note that, in general, it is not possible to select the low speed side by the speed mode selection means immediately after the high speed mode is selected by the speed mode selection means and the manipulation lever 10 is manipulated for hoisting, and thus, the controller 50 determines NO in Step S9.

Next, the controller 50 determines whether the manipulation lever 10 is neutral in Step S10 of FIG. 5. In Step S10, if the manipulation lever 10 is neutral, the control process transitions to Step S13. On the other hand, if the manipulation lever 10 is not neutral (non-neutral) in Step S10, the control process transitions to Step S7. Note that the manipulation lever 10 is non-neutral immediately after the start of the hoisting manipulation, and thus, the controller 50 determines NO in Step S10. Thereafter, the control flow from Step S7 to Step S10 continues in a loop. That is, while the control process loops from Step S7 to Step S10, the hoisting manipulation continues in the state where the high/low speed hydraulic motor 21 is in the high speed mode.

As described above, the calculated lifting load and wire rope tension start from zero and gradually increase in the initial stage of lifting off the ground regardless of the actual lifting load. Therefore, the winch system of the mobile crane according to the present invention can perform hoisting at high speed in the initial stage of lifting off the ground where the lifting load calculation value and wire rope tension calculation value are small if the high speed mode is selected by the speed mode selection means, thereby improving the crane operability.

If the controller 50 determines NO in Steps S7 and S8 of FIG. 5 in a state where the lifting off the ground is completed (see FIG. 7), the looping of the control flow from Step S7 to Step S10 continues. That is, in this case, the high/low speed hydraulic motor 21 is operated in the high speed mode until the manipulation lever is returned to the neutral position (Step S10).

Figure 6:
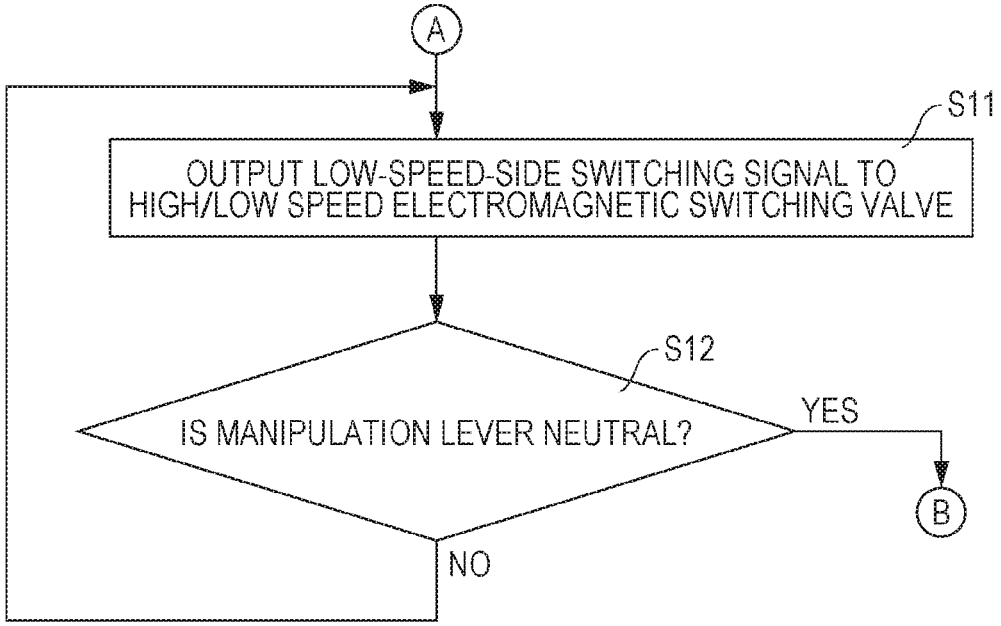
FIG. 6 is a flowchart illustrating processing performed by the controller.

On the other hand, if the controller 50 determines YES in Step S7 or Step S8 of FIG. 5 in the middle of lifting off the ground, a low-speed-side switching signal is output to the electromagnetic switching valve 33 in Step S11 of FIG. 6.

In this case, the low-speed-side switching signal is output from the drive control unit 64 illustrated in FIG. 3 to the electromagnetic switching valve 33. As illustrated in FIG. 2, the electromagnetic switching valve 33 is switched to the interruption side, the pilot pressure in the oil passage 34 acting on the pilot switching valve 30 returns to the tank, and the pilot switching valve 30 switches to the interruption side. Further, the pressure oil added to the control cylinder 24 returns to the tank via the oil passage 31 and the pilot switching valve 30. Then, the high/low speed motor 21, which is always biased to the low speed side, returns to the low speed side.

At this time, the hoisting is performed in the low speed mode since the output of the drive signal to the hoisting-side proportional solenoid valve 35 illustrated in Step S3 of FIG. 4 continues. When the operation in the low speed mode illustrated in FIG. 6 is started, the controller 50 determines whether the manipulation lever 10 is neutral in Step S12. If it is determined in Step S12 that the manipulation lever 10 is not neutral, the control flow loops in Steps S11 and S12 in FIG. 6. That is, the operation of the high/low speed hydraulic motor 21 in the low speed mode continues.

If the manipulation lever 10 is returned to neutral in Step S10 ("YES" in Step S10) during the operation in the high speed mode in which looping from Step S7 to Step S10 illustrated in FIG. 5 is performed, the control process transitions to Step S13. In Step S13, the low-speed-side switching signal is output to the electromagnetic switching valve 33 (see FIG. 2). In addition, the drive signal output to the hoisting-side proportional solenoid valve 35 is stopped in Step S14. That is, the high/low speed hydraulic motor 21 returns to the low speed side, the pilot switching valve 32 is switched to a neutral position, and the pressure oil from the hydraulic pump 40 is no longer supplied to the high/low speed hydraulic motor 21. Then, the high/low speed hydraulic motor 21 stops.

Similarly, if the manipulation lever 10 is neutral in Step S12 ("YES" in Step S12) during the operation in the low speed mode illustrated in FIG. 6, the drive signal output to the hoisting-side proportional solenoid valve 35 is stopped, and the high/low speed hydraulic motor 21 that is operating in the low speed mode stops in Step S14 in FIG. 5.

(Case of Lifting Off Ground and Hoisting Under Low Speed Mode Selection)

A description will be given regarding an example in the case of hoisting the suspended load 18 in the low speed mode from the state of being grounded on the ground 20 (see FIG. 1). First, the controller 50 determines whether the speed mode selection means 51 (see FIG. 3) has selected the high speed side in Step S1 of FIG. 4. In the case of this example, the controller 50 determines NO in Step S1.

Next, the controller 50 determines whether the manipulation lever 10 is neutral in Step S15 of FIG. 4. When the manipulation lever 10 is neutral in Step S15 ("YES" in Step S15), the control process returns to Step S1. On the other hand, if the manipulation lever 10 is non-neutral (on the hoisting side in the case of this example) in Step S15 ("NO" in Step S15), the drive signal is output to the hoisting-side proportional solenoid valve 35.

Next, the pilot pressure acts from the proportional solenoid valve 35 illustrated in FIG. 2 via the oil passage 37, and the pilot switching valve 32 is switched. Then, the pressure oil is sent from the hydraulic pump 40 to the oil passage 25 on the hoisting side via the oil passage 42. As a result, the high/low speed motor 21 drives the winch drum 22 to the hoisting side in the low speed mode. Thereafter, the flow illustrated in FIG. 6 is continued to continue the operation in the low speed mode.

(Case of Hoisting and Lowering from Suspended State Under High Speed Mode Selection)

Figure 7:
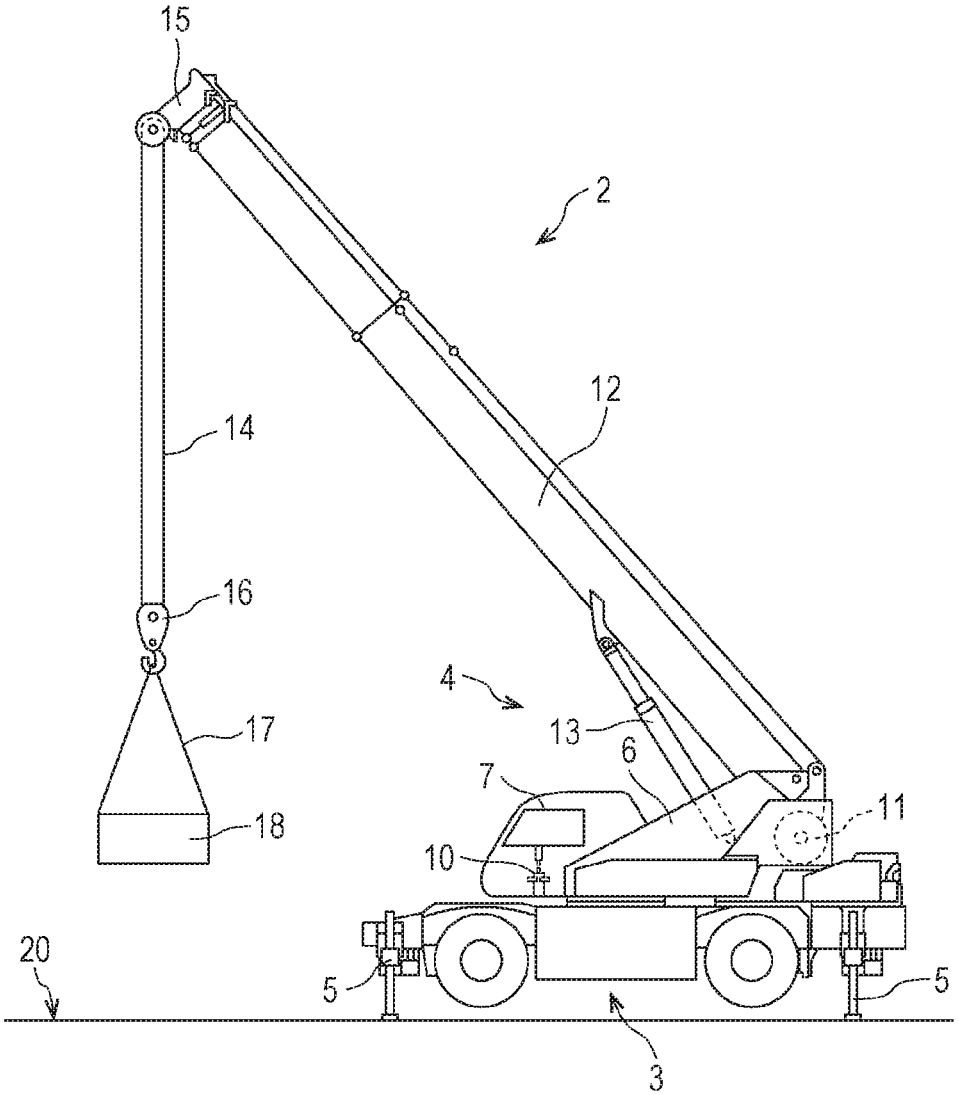
FIG. 7 is a view illustrating the rough terrain crane in a state of lifting a suspended load.

A description will be given regarding an example of hoisting and lowering in the high speed mode from the suspended state where the suspended load 18 is separated from the ground 20 (see FIG. 7).

First, the controller 50 determines whether the speed mode selection means 51 has selected the high speed side in Step S1 of FIG. 4. In the case of this example, the controller 50 determines YES in Step S1.

Next, the controller 50 determines whether the manipulation lever 10 is neutral in Step S2 of FIG. 4. If the manipulation lever 10 is non-neutral (on the hoisting side or the lowering side) in Step S2 of FIG. 4 ("NO" in Step S2), the drive signal is output to the hoisting-side proportional solenoid valve 35.

Then, the pilot pressure acts from the proportional solenoid valve 35 or the proportional solenoid valve 36 illustrated in FIG. 2 via the oil passage 37 or the oil passage 38, and the pilot switching valve 32 is switched. Then, the pressure oil is sent from the hydraulic pump 40 to the oil passage 25 on the hoisting side or the oil passage 26 on the lowering side via the oil passage 42. In this way, the operating pressure of the high/low speed hydraulic motor 21 is generated in the oil passage 25 on the hoisting side or the oil passage 26 on the lowering side. Note that the flow continues until the manipulation lever 10 is in the non-neutral state if the manipulation lever 10 is neutral in Step S2 ("YES" in Step S2).

Next, the controller 50 determines whether the suspended load calculation value is smaller than the suspended load threshold in Step S4 of FIG. 4. In the case of this example, the suspended load 18 is in the state of being suspended in the air so that the extension of the wire rope 14 and the bending of the telescoping boom 12 do not occur, and thus, a true suspended load value is calculated as the suspended load calculation value almost at the same time when the winch system 1 is started. Therefore, a calculated value of the true suspended load value and the suspended load threshold are compared in Step S4. If the calculated value of the true suspended load value is not smaller than the suspended load threshold in Step S4 ("NO" in Step S4), the control process transitions to Step S11 in FIG. 6. Then, the low-speed-side switching signal is output to the electromagnetic switching valve 33 in Step S11. As a result, the winch 11 operates in low speed mode.

On the other hand, if the calculated value of the true suspended load value is smaller than the suspended load threshold in Step S4 ("YES" in Step S4), the control process transitions to Step S5. The controller 50 determines whether the wire rope tension calculation value is smaller than the wire rope tension threshold in Step S5. In the case of this example, the suspended load 18 is in the state of being suspended in the air so that the extension of the wire rope 14 and the bending of the telescoping boom 12 do not occur, and thus, a true wire rope tension calculation value is calculated as the wire rope tension calculation value almost at the same time when the winch system 1 is started. Therefore, the true wire rope tension calculation value and the wire rope tension threshold are compared in Step S5. If the wire rope tension calculation value is not smaller than the wire rope tension threshold in Step S5 ("NO" in Step S4), the control processing transitions to Step S11 in FIG. 6, the low-speed-side switching signal is output to the electromagnetic switching valve 33, and the winch 11 operates in the low speed mode.

As above, it is determined whether all the four conditions such as the selection of the high speed side by the speed mode selection means 51 (condition 1), the manipulation from neutral to non-neutral of the manipulation lever 10 (condition 2), the suspended load calculation value being smaller than the suspended load threshold (condition 3), and the wire rope tension calculation value being smaller than the wire rope tension threshold (condition 4) are satisfied. As described above, in the case of hoisting and lowering from the suspended state under the high speed mode selection, the determination on the operating conditions that allow the high speed mode is completed in an extremely short time as compared with the hoisting from the lifting off the ground. Then, the operation in the high speed mode or the operation in the low speed mode continues. Note that the content of the control flow during the operation in the high speed mode illustrated in FIG. 5 is the same as that in the case of starting from the lifting off the ground, and thus, the detailed description thereof is omitted.

(Case of Hoisting and Lowering from Suspended State Under Low Speed Mode Selection)

A description will be given regarding an example of hoisting and lowering in the low speed mode from the suspended state where the suspended load 18 is separated from the ground 20 (see FIG. 7). First, the controller 50 determines whether the speed mode selection means 51 has selected the high speed side in Step S1 of FIG. 4. In the case of this example, the controller 50 determines NO in Step S1.

Next, the controller 50 determines whether the manipulation lever 10 is neutral in Step S15 of FIG. 4. When the manipulation lever 10 is neutral in Step S15 ("YES" in Step S15), the control process transitions to Step 1. On the other hand, if the manipulation lever 10 is non-neutral (on the hoisting side or the lowering side) in Step S15 ("NO" in Step S15), the drive signal is output to the hoisting-side proportional solenoid valve 35 or the lowering-side proportional solenoid valve 36 in Step S16. Hereinafter, the flow illustrated in FIG. 6 continues and the operation in the low speed mode continues, and thus, the detailed description thereof will be omitted.

APPENDIX

The winch system provided in the crane according to the present invention may have the following configuration.

<First Example of Winch System>

Specifically, the above winch system includes: the winch driven by the high/low speed hydraulic motor; the manipulation lever for manipulating the winch; the speed mode selection means capable of selecting the high speed mode or the low speed mode of the high/low speed hydraulic motor; the load detection means for detecting the length of the telescoping boom, the derricking angle, and the pressure of the derricking cylinder; the wire rope multiplier input means for inputting the multiplier of the wire rope; and the controller for receiving the signals from the manipulation lever, the speed mode selecting means, the load detection means, and the wire rope multiplier input means and outputting the drive signal to the winch.

The high/low speed hydraulic motor includes the control cylinder for switching control of the motor displacement between large and small, and the high/low speed switching valve for switching between communication and interruption of the motor operating pressure with respect to the control cylinder.

When the motor displacement is constantly biased to the large displacement side and the high/low speed switching valve is switched to the high speed side, the motor operating pressure communicates with the control cylinder so that the motor displacement is switched to the smaller displacement side.

The controller includes: the suspended load calculation unit that calculates the suspended load; the wire rope tension calculation unit that calculates the wire rope tension; the suspended load comparison unit that compares the suspended load calculation value with the suspended load threshold; the wire rope tension comparison unit that compares the wire rope tension calculation value with the wire rope tension threshold; and the drive control unit that outputs the switching signal of the high/low speed switching valve based on the signals from the manipulation lever, the speed mode selection means, the suspended load comparison unit, and the wire rope tension comparison unit.

The drive control unit outputs the signal for switching the high/low speed switching valve to the high speed side if the speed mode selection means selects the high speed side, the manipulation lever is manipulated from neutral to non-neutral, the suspended load calculation value is smaller than the suspended load threshold, and the wire rope tension calculation value is smaller than the wire rope tension threshold.

According to such a winch system, the hoisting can be performed at high speed in the initial stage of lifting off the ground where the lifting load calculation value and the wire rope tension calculation value are small, the operability of the crane is improved.

In addition, when the condition that the suspended load is smaller than the suspended load threshold and the condition that the wire rope tension is smaller than the wire rope tension threshold are simultaneously satisfied, the high/low speed switching valve is switched to the high speed side. Therefore, even if an incorrect wire rope multiplier is input, switching to the high speed side is prevented under conditions where an excessive rope tension acts.

<Second Example of Winch System>

In addition, when implementing the above winch system, preferably, the drive control unit outputs the signal for switching the high/low speed switching valve to the low speed side if the suspended load comparison unit continuously detects the state where the suspended load calculation value is not smaller than the suspended load threshold for the predetermined time or if the wire rope tension comparison unit continuously detects the state where the wire rope tension calculation value is not smaller than the wire rope tension threshold for the predetermined time in the state where the high/low speed switching valve is switched to the high speed side.

According to the above-described winch system, it is possible to prevent the operating pressure of the high/low speed hydraulic motor from exceeding an allowable range. The reason for this is because the high/low speed hydraulic motor is switched to the low speed side (large displacement side) even in the state where the speed mode selection means is switched to the high speed side if the state where the suspended load is not smaller than the suspended load threshold is continuously detected for the predetermined time or if the wire rope tension comparison unit continuously detects the state where the wire rope tension calculation value is not smaller than the wire rope tension threshold for the predetermined time.

In addition, frequent switching between high speed and low speed, which is caused by the apparent load change accompanying the vibration of the telescoping boom or the wire rope, is prevented since the determination condition is that the state of being not smaller than the threshold continues for the predetermined time, so that stable control is performed.

<Third Example of Winch System>

In addition, when implementing the above-described winch system, it is preferable that the drive control unit continues to output the signal for switching the high/low speed switching valve to the low speed side until the manipulation lever becomes neutral.

According to such a winch system, it is possible to prevent the mode from switching due to the fluctuation of a detected value even under a condition that a detected suspended load or a detected wire rope tension is close to the threshold. The reason for this is because the low speed mode is maintained until the manipulation lever becomes neutral if the high/low speed hydraulic motor is switched to the low speed side (large displacement side) during the operation in the high speed mode in the state where the speed mode selection means has been switched to the high speed side.

<Fourth Example of Winch System>

In addition, when implementing the above-described winch system, it is preferable that the drive control unit output the signal for switching the high/low speed switching valve to the low speed side if the speed mode selection means is switched to the low speed side in the state where the high/low speed switching valve has been switched to the high speed side.

According to such a winch system, it is possible to switch to the low speed mode according to the operator's intention even if the speed mode selection means is switched to the high speed side and is in the state of operating in the high speed mode.

REFERENCE SIGNS LIST

1 winch system
10 manipulation lever
11 winch
12 telescoping boom
13 derricking cylinder
14 wire rope
15 distal end portion
16 hook
18 suspended load
2 rough terrain crane
20 ground
21 high/low speed hydraulic motor
22 winch drum
23 speed reducer
24 control cylinder
25 oil passage on hoisting side
26 oil passage on lowering side
27 counter balance valve
28 shuttle valve
3 vehicle section
30, 32 pilot switching valve
31, 34 oil passage
33 electromagnetic switching valve
35, 36 proportional solenoid valve
37, 38 oil passage
4 swivel section
40 pump
41 tank
42, 43 oil passage
5 outrigger
50 controller
51 speed mode selection means
52 load detection means
53 wire rope multiplier input means
54 boom length detector
55 angle detector
56 pressure detector
6 flame
60 suspended load calculation unit
61 wire rope tension calculation unit
62 suspended load comparison unit
63 wire rope tension comparison unit
64 drive control unit
7 cab

The invention claimed is:

1. A crane comprising:

a manipulation unit;

a winch device that operates with an actuation mode of either a high speed mode or a low speed mode based on manipulation of the manipulation unit, and winds in or reels out a wire rope to which a hook is fixed;

a selection unit for an operator to select either the high speed mode or the low speed mode;

a load calculation unit for calculating a suspended load;

a tension calculation unit for calculating a tension of the wire rope; and a control unit for controlling actuation of the winch device, wherein the winch device comprises a high/low speed hydraulic motor capable of switching between a first mode corresponding to the high speed mode and a second mode corresponding to the low speed mode, if determining that a mode selected by the selection unit is the high speed mode, the manipulation unit is in a state of being manipulated to a hoisting side or in a state of being manipulated on a lowering side as a non-neutral state from a neutral state, the suspended load is smaller than a load threshold, and the tension is smaller than a tension threshold, the control unit switches the high/low speed hydraulic motor to the first mode to operate the winch device in the high speed mode, starts to wind in the wire rope using the winch device when the manipulation unit is manipulated to the hoisting side, and starts to reel out the wire rope using the winch device when the manipulation unit is manipulated to the lowering side.

2. The crane according to claim 1, wherein the high/low speed hydraulic motor includes a high/low speed switching valve and a control cylinder, the high/low speed switching valve is capable of switching between a first state where hydraulic oil is supplied from the high/low speed switching valve to the control cylinder and a second state where supply of the hydraulic oil from the high/low speed switching valve to the control cylinder is interrupted, under control of the control unit, and the high/low speed hydraulic motor has a motor displacement on a large displacement side corresponding to the low speed mode in the second state, and has the motor displacement on a small displacement side corresponding to the high speed mode in the first state.

3. The crane according to claim 1, wherein the control unit performs switching control to switch the actuation mode from the high speed mode to the low speed mode if a state where the suspended load is equal to or larger than the suspended load threshold continues for a predetermined time or if a state where the tension is equal to or larger than the tension threshold continues for a predetermined time in a state where the winch device operates in the high speed mode.

4. The crane according to claim 3, wherein after the switching control, the control unit maintains the actuation mode in the low speed mode until the manipulation lever becomes neutral.

5. The crane according to claim 1, wherein the control unit controls the winch device to operate in the low speed mode if the low speed mode is selected by the selection unit in a state where the actuation mode is the high speed mode.

* * * * *